US007967078B2

(12) United States Patent
Aoki

(10) Patent No.: US 7,967,078 B2
(45) Date of Patent: Jun. 28, 2011

(54) IMPACT TOOL

(75) Inventor: Yonosuke Aoki, Anjo (JP)

(73) Assignee: Makita Corporation, Anjo (JP)

( * ) Notice: Subject to any disclaimer, the term of this patent is extended or adjusted under 35 U.S.C. 154(b) by 120 days.

(21) Appl. No.: 12/461,815

(22) Filed: Aug. 25, 2009

(65) Prior Publication Data

US 2010/0051304 A1 Mar. 4, 2010

(30) Foreign Application Priority Data

Aug. 29, 2008 (JP) ..... 2008-222106

(51) Int. Cl.
*B25D 17/24* (2006.01)

(52) U.S. Cl. ..... 173/201; 173/109; 173/162.1; 173/212

(58) Field of Classification Search ..... 173/49, 173/109, 210, 211, 212, 201, 162.1, 162.2
See application file for complete search history.

(56) References Cited

U.S. PATENT DOCUMENTS

| | | | | |
|---|---|---|---|---|
| 4,478,293 | A * | 10/1984 | Weilenmann et al. | 173/162.2 |
| 4,567,951 | A * | 2/1986 | Fehrle et al. | 173/201 |
| 6,907,943 | B2 * | 6/2005 | Ikuta | 173/117 |
| 6,913,088 | B2 * | 7/2005 | Berger | 173/48 |
| 7,096,973 | B2 * | 8/2006 | Ikuta et al. | 173/201 |
| 7,252,157 | B2 * | 8/2007 | Aoki | 173/162.2 |
| 7,331,407 | B2 * | 2/2008 | Stirm et al. | 173/201 |
| 7,588,097 | B2 * | 9/2009 | Kamegai et al. | 173/162.1 |
| 7,743,514 | B2 * | 6/2010 | Oki et al. | 30/392 |
| 2008/0047723 | A1 | 2/2008 | Kamegai et al. | |
| 2008/0179797 | A1 | 7/2008 | Manschitz et al. | |

FOREIGN PATENT DOCUMENTS

| | | | |
|---|---|---|---|
| EP | 1 815 946 | A1 | 8/2007 |
| EP | 1 870 209 | A1 | 12/2007 |
| EP | 1 932 627 | A2 | 6/2008 |
| EP | 1 952 952 | A2 | 8/2008 |
| EP | 2 018 939 | A2 | 1/2009 |
| JP | A-2008-73836 | | 4/2008 |
| WO | WO 03/018342 | A2 | 3/2003 |

OTHER PUBLICATIONS

European Search Report issued Feb. 10, 2011 in European Application No. EP 09 01 1068.

* cited by examiner

*Primary Examiner* — Scott A. Smith
(74) *Attorney, Agent, or Firm* — Oliff & Berridge, PLC

(57) ABSTRACT

It is an object of the invention to provide a rational forced vibration of a dynamic vibration reducer in an impact tool that linearly drives a tool bit in an axial direction of the tool bit via a swinging member.

An impact tool includes a motor 111, a swinging member 129 that swings in the axial direction of a tool bit 119 by rotation of the motor 111, a driving element 141 that is caused to reciprocate by swinging movement of the swinging member 129 and a first air chamber 143*a* in which pressure is fluctuated by reciprocating movement of the driving element 141, and the tool bit 119 is driven by pressure fluctuations of the first air chamber 143*a*. The impact tool further includes a second air chamber 163 in which pressure is fluctuated by swinging movement of the swinging member 129, and a dynamic vibration reducer 151 having a weight 155 and an elastic element 157 which exerts a biasing force on the weight 155. The weight 155 under the biasing force of the elastic element 157 is forcibly vibrated by pressure fluctuations of the second air chamber 163.

7 Claims, 4 Drawing Sheets

IMPACT TOOL

BACKGROUND OF THE INVENTION

1. Field of the Invention

The invention relates to a vibration reducing technique for an impact tool which linearly drives a tool bit by means of a swinging member.

2. Description of the Related Art

Japanese non-examined laid-open Patent Publication No. 2008-73836 discloses an electric hammer drill that drives a hammer bit by using a swinging mechanism (also referred to as "swash mechanism"). The kwon art includes a vibration reducing mechanism having a dynamic vibration reducer mounted to a tool body of the hammer drill. The dynamic vibration reducer is designed to actively drive or forcibly vibrate a weight of the dynamic vibration reducer by directly utilizing swinging movement of a swinging member in the form of the swinging ring and thereby reduce vibration caused during hammering operation. Thus, regardless of magnitude of vibration that acts upon the impact tool, the dynamic vibration reducer can be steadily operated.

The known vibration reducing mechanism is of the mechanical type that vibrates the dynamic vibration reducer by using machine parts directly operated by swinging movement of the swinging ring. Therefore, the number of machine parts relating to such vibration increase and it is necessary to move the weight of the dynamic vibration reducer in a direction opposite to the direction of movement of the hammer bit. Due to these facts, a vibration mechanism section has to be disposed on the opposite side of the center of swinging movement from a hammer bit driving mechanism section and is thus difficult to dispose by utilizing a free space within the tool body. Therefore, in these respects, further improvement is required.

SUMMARY OF THE INVENTION

Accordingly, it is an object of the invention to provide a rational forced vibration of a dynamic vibration reducer in an impact tool that linearly drives a tool bit in an axial direction of the tool bit via a swinging member.

In order to solve the above-described problem, a representative impact tool according to the invention is provided to perform a hammering operation by linearly driving a tool bit at least in an axial direction of the tool bit. The representative impact tool includes a motor, a swinging member that swings in the axial direction of the tool bit by rotation of the motor, a driving element that reciprocates by a swinging movement of the swinging member and a first air chamber in which pressure is fluctuated by reciprocating movement of the driving element and the tool bit is driven by pressure fluctuations of the first air chamber. The impact tool further includes a second air chamber in which pressure is fluctuated by swinging movement of the swinging member and a dynamic vibration reducer having a weight and an elastic element that exerts a biasing force on the weight. The weight under the biasing force of the elastic element is forcibly vibrated by pressure fluctuations of the second air chamber.

According to a preferred embodiment of the invention, the second air chamber may be provided in which pressure is fluctuated by a swinging movement of the swinging member, and the weight of the dynamic vibration reducer is forcibly vibrated by pressure fluctuations of the second air chamber. With the construction in which the weight is vibrated by utilizing fluctuations of air pressure, the number of machine parts can be reduced compared with a mechanical vibration mechanism. Further, by using the system of pneumatic vibration by pressure fluctuations of air, it can be constructed such that the second air chamber and the dynamic vibration reducer are connected by a passage, so that constraints on the installation place for the second air chamber can be lessened. Therefore, the second air chamber can be easily formed by utilizing a free space existing around the swinging member. Thus, according to the invention, a rational pneumatic vibration mechanism can be realized by utilizing the free space.

According to a further embodiment of the invention, the impact tool may have a driving member mounted to the swinging member to fluctuate pressure in the second air chamber. The driving member and the driving element are disposed on the opposite sides of the swinging member. In the impact tool having the construction in which the driving element is driven by swinging movement of the swinging member, the driving element is disposed on one side of the swinging member in the swinging direction, but a free space exists on the other side of the swinging member in the swinging direction. According to the invention, the second air chamber and the driving member can be rationally installed by utilizing this free space. Particularly in the invention, by provision of the system of vibration by pressure fluctuations of air, even in the construction in which the driving member is disposed on the opposite side of the swinging member from the driving element, the weight of the dynamic vibration reducer can be moved in a direction opposite to the tool bit.

In a further embodiment of the impact tool according to the invention, the driving member and the driving element are coaxially disposed. When the driving member and the driving element are linearly driven by swinging movement of the swinging member and air of the second air chamber or the first air chamber is compressed, a reaction force caused by this compression is transmitted from the driving member to the driving element or from the driving element to the driving member via the swinging member. In this case, according to the invention, with the construction in which the driving member and the driving element are coaxially disposed, the reaction force is transmitted along the same axis, so that useless stress which, for example, may cause a twist is not easily generated on the swinging member, so that durability can be effectively enhanced.

According to a further embodiment of the invention, the driving member and the driving element are integrally formed with each other. With such a construction, the number of parts can be reduced, which leads to improvement in ease of assembling operation.

Other objects, features and advantages of the invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
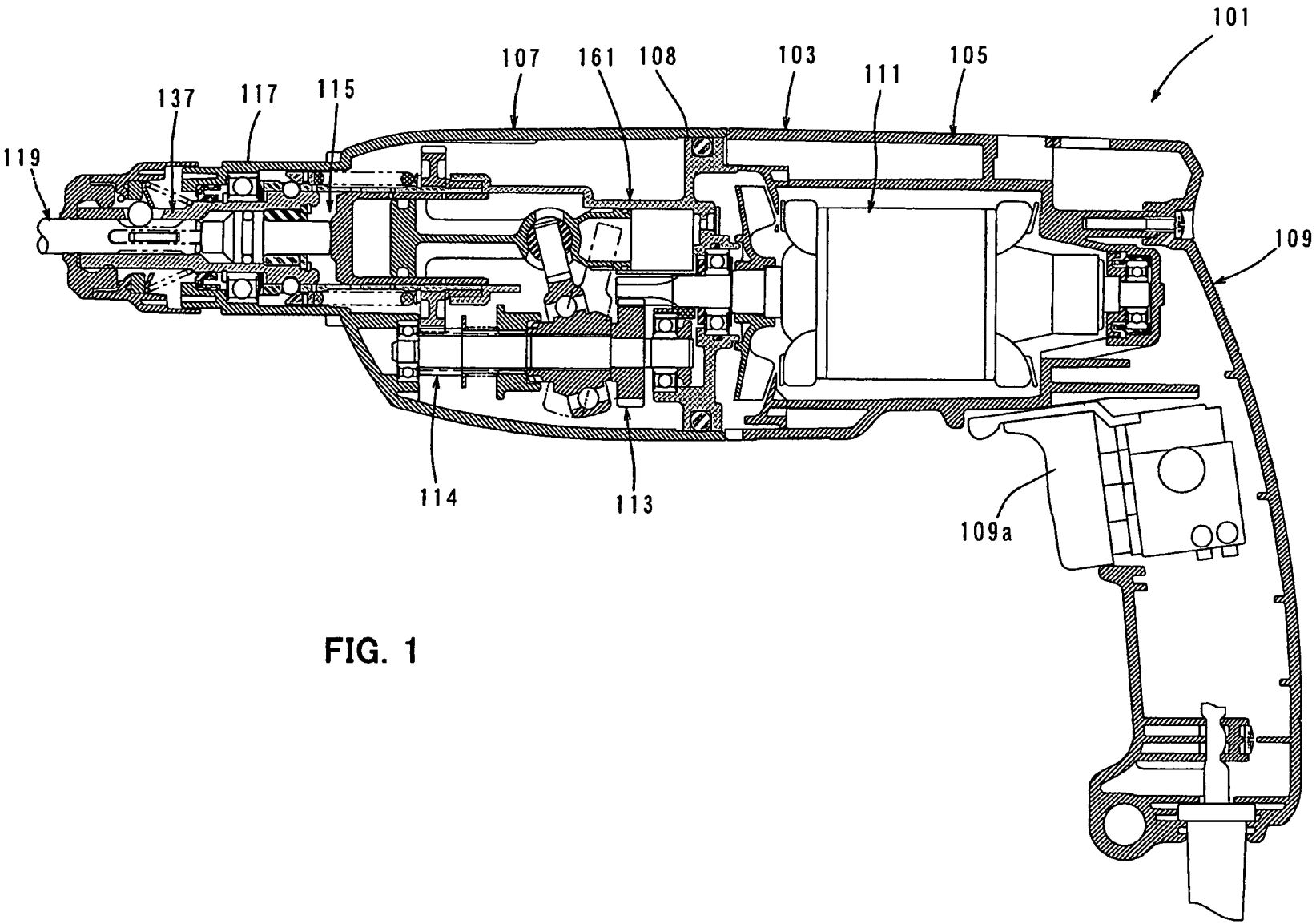
FIG. 1 is a sectional side view schematically showing an entire hammer drill 101 according to an embodiment of this invention.
Figure 2:
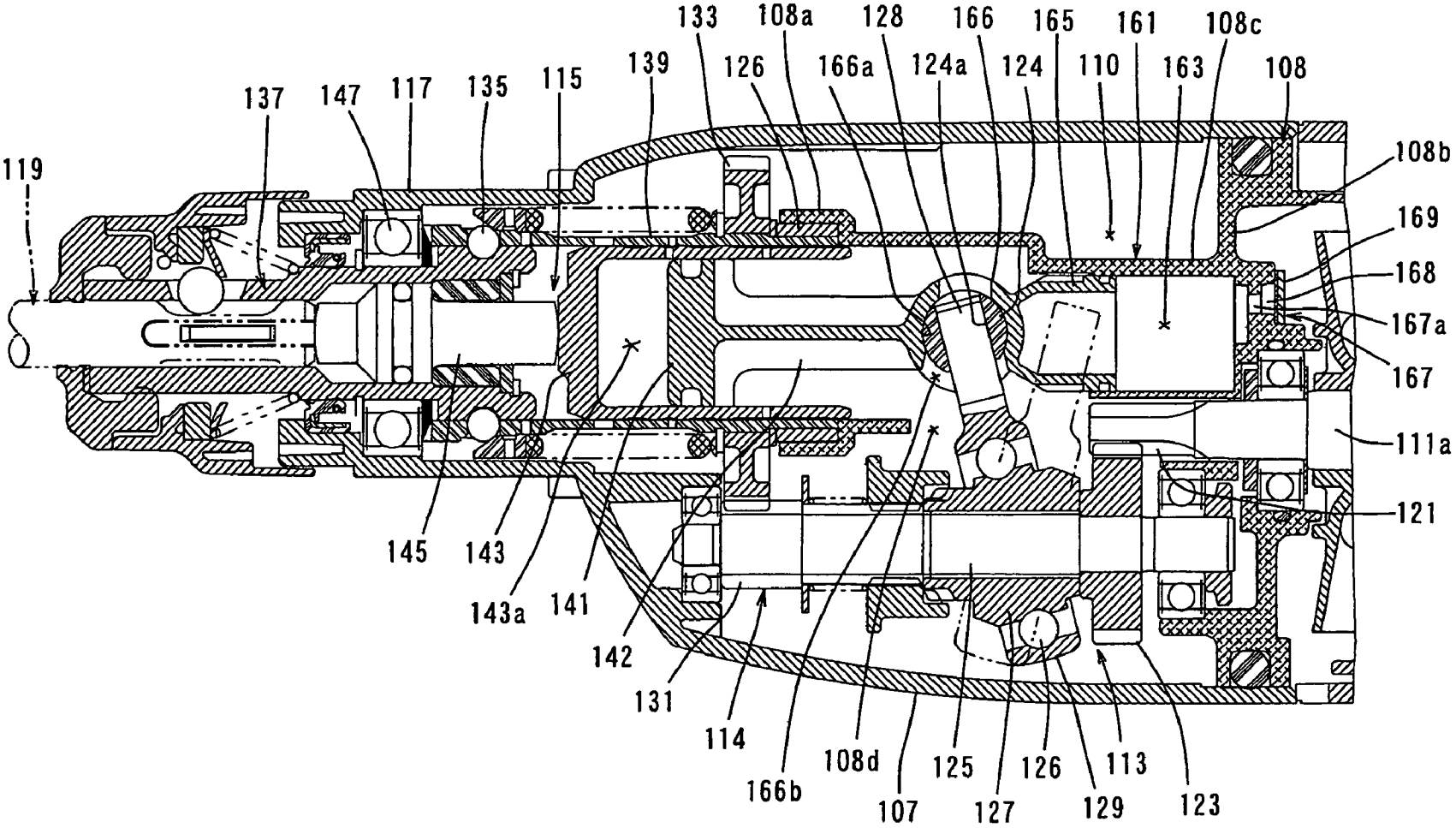
FIG. 2 is an enlarged sectional view showing an essential part of the hammer drill 101.

An embodiment of an impact tool according to the invention is now described with reference to the drawings. FIG. 1 is a sectional side view showing an entire electric hammer drill 101 as a representative embodiment of the impact tool according to the invention. FIG. 2 is an enlarged sectional view showing an essential part of the hammer drill 101.

As shown in FIG. 1, the hammer drill 101 according to this embodiment mainly includes a body 103 that forms an outer shell of the hammer drill 101 and an elongate hammer bit 119 that is detachably coupled to one end (left end as viewed in FIG. 1) of the body 103 in a longitudinal direction of the hammer drill 101. The body 103 is provided as a component part for forming a tool body. The hammer bit 119 is held by the tool holder 137 such that it is allowed to reciprocate with respect to the tool holder 137 in its axial direction (in the longitudinal direction of the body 103) and prevented from rotating with respect to the tool holder 137 in its circumferential direction. The hammer bit 119 is a feature that corresponds to the "tool bit" according to the invention.

The body 103 includes a motor housing 105 that houses a driving motor 111, a gear housing 107 that houses a motion converting section 113, a power transmitting section 114 and a striking mechanism 115, and a handgrip 109 that is connected to the other end (right end as viewed in FIG. 1) of the body 103 in the axial direction of the hammer drill 101 and designed to be held by a user. The driving motor 111 is driven when a user depresses a trigger 109*a* disposed on the handgrip 109. Further, in this embodiment, for the sake of convenience of explanation, the side of the hammer bit 119 is taken as the front or tool front side, and the side of the handgrip 109 as the rear or tool rear side.

FIG. 2 shows the motion converting section 113, the power transmitting section 114 and the striking mechanism 115 in enlarged sectional view. The motion converting section 113 serves to convert the rotating output of the driving motor 111 into linear motion and then transmit it to the striking mechanism 115. Then, a striking force (impact force) is generated in the axial direction of the hammer bit 119 via the striking mechanism 115. The motion converting section 113 mainly includes a driving gear 121, a driven gear 123, a driven shaft 125, a rotating element 127, a swinging ring 129 and a piston 141.

The driving gear 121 is connected to a motor output shaft 111*a* of the driving motor 111 that extends in the axial direction of the hammer bit 119 and rotationally driven when the driving motor 111 is driven. The driven gear 123 engages with the driving gear 121 and the driven shaft 125 is mounted to the driven gear 123. Therefore, the driven shaft 125 is connected to the motor output shaft 111*a* of the driving motor 111 and rotationally driven. The driving motor 111 is a feature that corresponds to the "motor" according to the invention.

The rotating element 127 rotates together with the driven gear 123 via the driven shaft 125. The outer periphery of the rotating element 127 fitted onto the driven shaft 125 is inclined at a predetermined inclination with respect to the axis of the driven shaft 125. The swinging ring 129 is rotatably mounted on the inclined outer periphery of the rotating element 127 via a bearing 126 and caused to swing in the axial direction of the hammer bit 119 by rotation of the rotating element 127. The swinging ring 129 is a feature that corresponds to the "swinging member" according to the invention. Further, the swinging ring 129 has a swinging rod 128 extending upward (in the radial direction) therefrom in a direction transverse to the axial direction of the hammer bit 119, and the swinging rod 128 is connected to the piston 141 via a ball (steel ball) 124 such that the swinging rod 128 can pivot in all directions.

The piston 141 is caused to reciprocate in the axial direction of the hammer bit within a cylindrical hammer 143 having a bottom by swinging movement of the swinging ring 129, and serves as a driving element for driving the striking mechanism 115. The piston 141 is a feature that corresponds to the "driving element" according to this invention. In this embodiment, the motor output shaft 111*a* of the driving motor 111, the driven shaft 125 and the piston 141 each extend in the axial direction of the hammer bit 119 and are disposed in parallel to each other. Further, in this embodiment, the driven shaft 125 is disposed below the motor output shaft 111*a* of the driving motor 111 and the piston 141 is disposed above the driven shaft 125.

The power transmitting section 114 serves to appropriately reduce the speed of the rotating output of the driving motor 111 and transmit it to the hammer bit 119 so that the hammer bit 119 is caused to rotate in its circumferential direction. The power transmitting section 114 is disposed to the hammer bit 119 side of the driving motor 111 in the axial direction of the hammer bit 119. The power transmitting section 114 according to this embodiment mainly includes a first transmission gear 131, a second transmission gear 133, a hammer guide 139 and a tool holder 137.

The first transmission gear 131 is caused to rotate in a vertical plane by the driving motor 111 via the driving gear 121 and the driven shaft 125. The second transmission gear 133 is engaged with the first transmission gear 131 and rotates the tool holder 137 on its axis when the driven shaft 125 rotates. The hammer guide 139 extends in the axial direction of the hammer bit 119 and serves to guide linear movement of the hammer 143. Further, the hammer guide 139 is configured as a cylindrical element that is rotated together with the second transmission gear 133. The tool holder 137 extends in the axial direction of the hammer bit 119 and serves as a holding element to hold the hammer bit 119. Further, the tool holder 137 is rotated together with the hammer guide 139 via a torque limiter 135.

The tool holder 137 is rotatably supported via the bearing 147 by a cylindrical barrel 117 which is integrally formed on the front end of the gear housing 107. Further, the hammer guide 139 is rotatably supported via a bearing 126 by a cylindrical guide holding portion 108*a* which is formed on an inner housing 108 within the gear housing 107.

The striking mechanism 115 mainly includes the hammer 143 having a cylindrical shape with a bottom and fitted within the bore of the hammer guide 139 such that it can slide in the axial direction of the hammer bit, and an intermediate element in the form of an impact bolt 145 that is slidably fitted within the tool holder 137 and serves to transmit kinetic energy of the hammer 143 to the hammer bit 119. An air spring chamber 143*a* is defined by a bore inner wall of the hammer 143 and an axial front end surface of the piston 141 which is slidably fitted into the bore. The hammer 143 is configured as a striker that is caused to move forward via the air spring chamber 143*a* by linear movement of the piston 141 and strikes the hammer bit 119. The air spring chamber 143*a* is formed on an extension of the axis of the hammer bit 119. The air spring chamber 143*a* is a feature that corresponds to the "first air chamber" according to the invention.

In the hammer drill 101 having the above-described construction, when the driving motor 111 is driven, the driving gear 121 is caused to rotate in a vertical plane by the rotating output of the driving motor 111. Then, the rotating element 127 is caused to rotate in a vertical plane via the driven gear 123 that is engaged with the driving gear 121, and the driven shaft 125, which in turn causes the swinging ring 129 and the swinging rod 128 to swing in the axial direction of the hammer bit 119. Then, the piston 141 is caused to linearly slide by the swinging movement of the swinging rod 128. By the action of the air spring function (pressure fluctuations) within the air spring chamber 143*a* as a result of this sliding movement of the piston 141, the hammer 143 linearly moves within the hammer guide 139. At this time, the hammer 143 collides with the impact bolt 145 and transmits the kinetic energy caused by the collision to the hammer bit 119. When the first transmission gear 131 is caused to rotate together with the driven shaft 125, the hammer guide 139 is caused to rotate in a vertical plane via the second transmission gear 133 that is engaged with the first transmission gear 131, which in turn causes the tool holder 137 and the hammer bit 119 held by the tool holder 137 to rotate in the circumferential direction together with the hammer guide 139. Thus, the hammer bit 119 performs a hammering movement in the axial direction and a drilling movement in the circumferential direction, so that a hammer drill operation is performed on the workpiece.

In this embodiment, the hammer bit 119 is struck by the hammer 143 formed by a cylindrical member, and the piston 141 disposed within the hammer 143 is driven by the swinging ring 129. Therefore, in contrast to the known construction in which the piston driven by the swinging ring is formed, for example, by a cylindrical member and the striker disposed within the cylindrical piston strikes the hammer bit, the piston 141 can be shaped like a disk. As a result, the piston 141 can be reduced in its mass (weight), so that vibration caused in the hammer drill 101 can be effectively reduced. Further, the hammer 143 that houses the piston 141 has a cylindrical shape having a bottom and it structurally has a predetermined length in the axial direction of the hammer 143. Therefore, a physically rational construction is obtained by using a cylindrical member as the hammer 143 which requires weight.

In this embodiment, the piston 141 is made of resin. Therefore, when the hammer drill 101 is driven, the temperature within the air spring chamber 143*a* is elevated by compression of air, so that heat must be dissipated. In this embodiment, a wall surface of the air spring chamber 143*a* is defined by the hammer 143 which is a cylindrical member made of iron, so that the heat within the air spring chamber 143*a* is dissipated via the hammer 143. Therefore, as for the piston 141, it is not necessary to particularly consider the heat dissipating ability of the air spring chamber 143*a*. Specifically, the piston 141 can be made of resin, so that weight reduction and cost reduction can be effectively realized.

Figure 3:
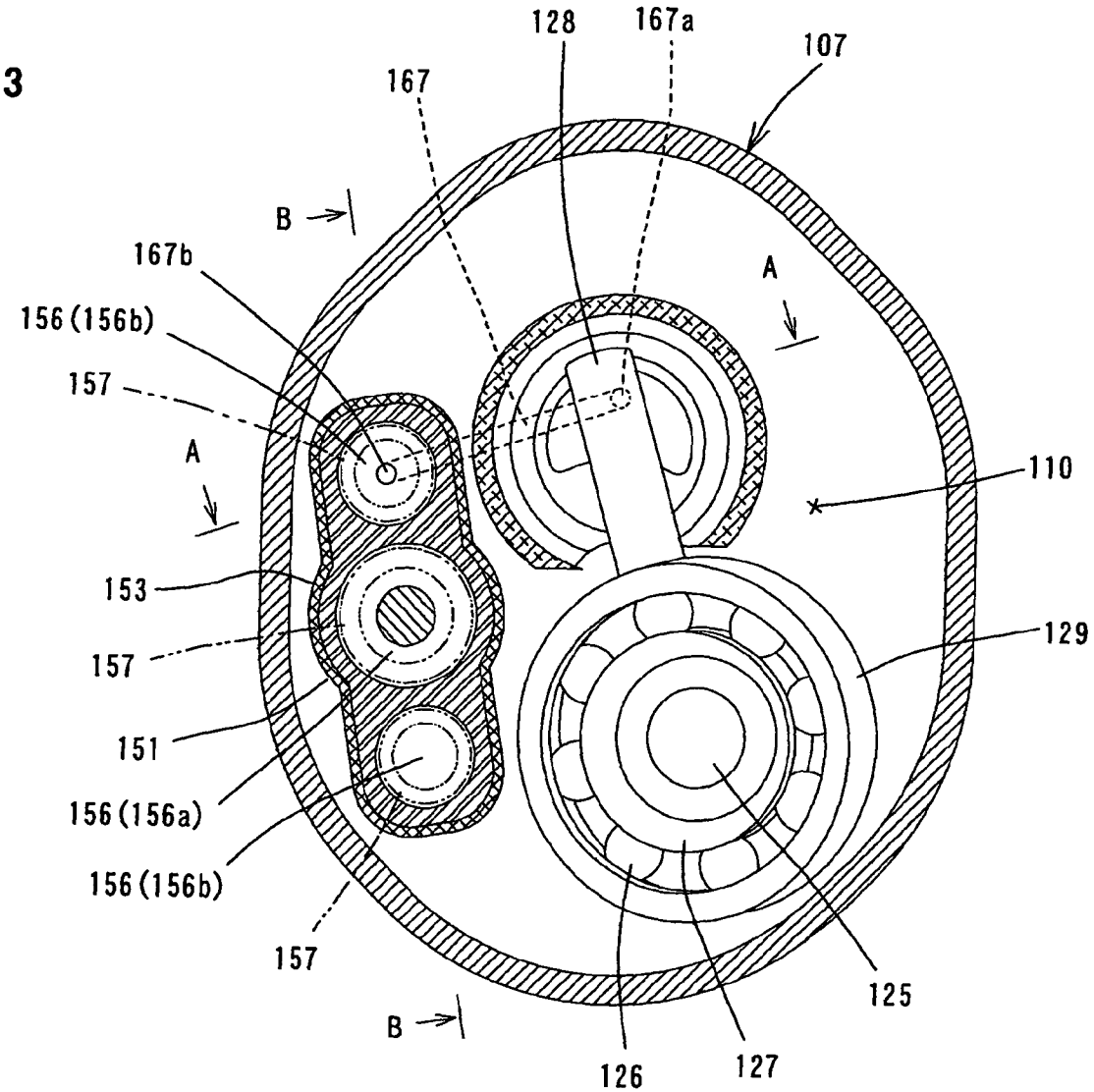
FIG. 3 is a sectional view showing a sectional structure of a dynamic vibration reducer 151 and its surrounding members as viewed from the front of the hammer drill 101.
Figure 4:
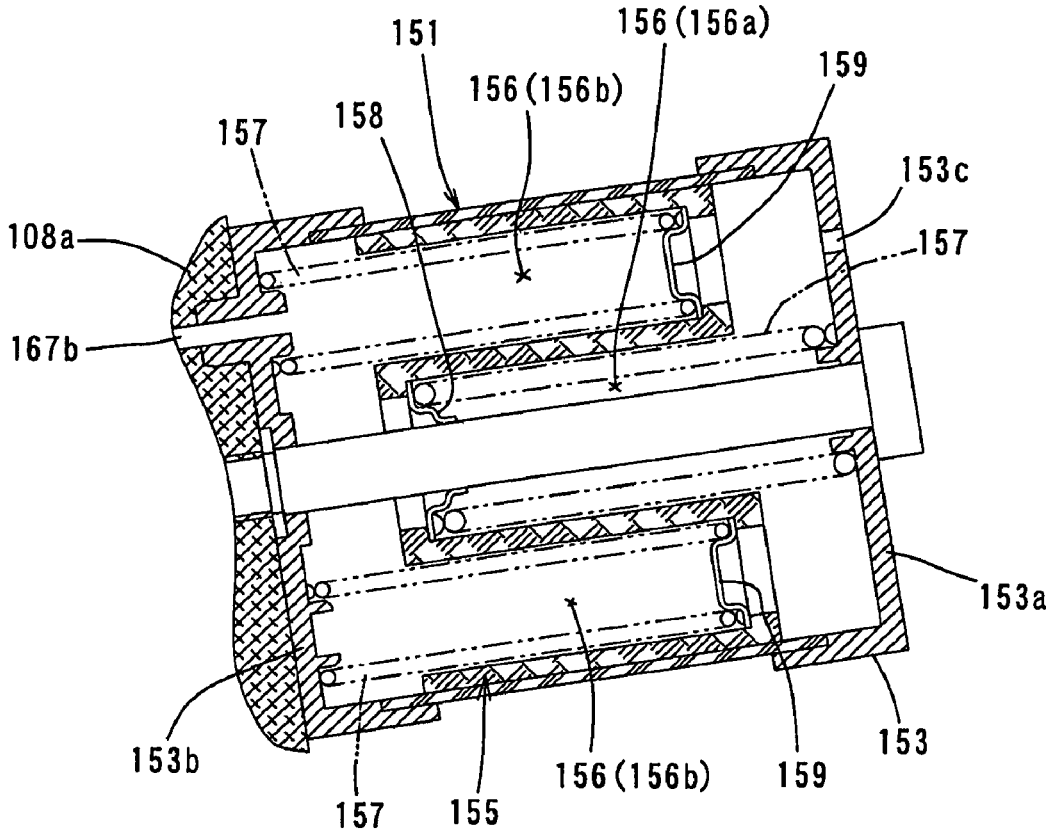
FIG. 4 is a sectional view taken along line A-A in FIG. 3.
Figure 5:
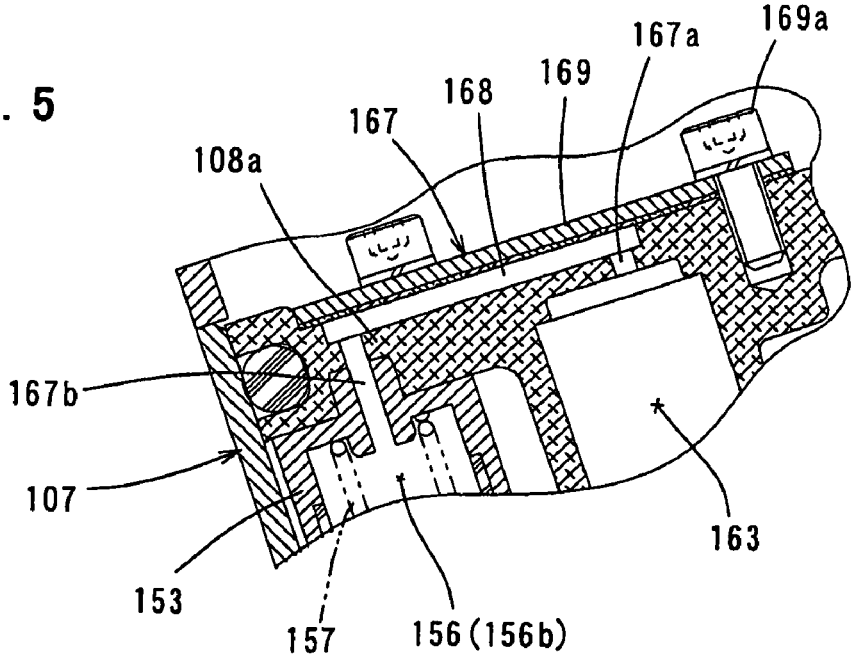
FIG. 5 is a sectional view taken along line B-B in FIG. 3.

Further, when the hammer drill 101 is driven, impulsive and cyclic vibration is caused in the body 103 in the axial direction of the hammer bit 119. In order to reduce such vibration, the hammer drill 101 of this embodiment is provided with a dynamic vibration reducer 151. FIG. 3 is a sectional view showing the sectional structure of the dynamic vibration reducer 151 and its surrounding members as viewed from the front of the hammer drill 101. Further, FIG. 4 is a sectional view taken along line A-A in FIG. 3 and FIG. 5 is a sectional view taken along line B-B in FIG. 3. As shown in FIGS. 3 to 5, the dynamic vibration reducer 151 mainly includes a dynamic vibration reducer body 153, a weight 155 for vibration reduction, and front and rear coil springs 157 disposed on the tool front and rear sides of the weight 155 and extending in the axial direction of the hammer bit 119. The dynamic vibration reducer 151 is a feature that corresponds to the "dynamic vibration reducer" according to the invention.

The dynamic vibration reducer body 153 has a housing space for housing the weight 155 and the coil spring 157 and is provided as a cylindrical guide for guiding the weight 155 to slide with stability. The dynamic vibration reducer body 153 is fixedly mounted to the body 103.

The weight 155 is configured as a mass part which is slidably disposed within the housing space of the dynamic vibration reducer body 153 in such a manner as to move in the longitudinal direction of the housing space (in the axial direction of the hammer bit 119). The weight 155 is a feature that corresponds to the "weight" according to the invention. The weight 155 has spring receiving spaces 156 having a circular section and extending in the form of a hollow in the axial direction of the hammer bit 119 over a predetermined region in the front and rear portions of the weight 155. One end of each of the coil springs 157 is received in the associated spring receiving space 156. In this embodiment, as shown in FIGS. 3 and 4, three spring receiving spaces 156 are arranged in a vertical direction transverse to the axial direction of the hammer bit 119. One of the three spring receiving spaces 156 which are formed in the front portion of the weight 155 (the right region of the weight 155 as viewed in FIG. 4) is referred to as a first spring receiving space 156*a*, and the other two in the rear portion of the weight 155 (the left region of the weight 155 as viewed in FIG. 4) are referred to as second spring receiving spaces 156*b*. The first spring receiving space 156*a* receives the coil spring 157 disposed on the front of the weight 155, while the second spring receiving spaces 156*b* receive the coil springs 157 disposed on the rear of the weight 155.

The coil springs 157 are configured as elastic elements which support the weight 155 with respect to the dynamic vibration reducer body 153 or the body 103 such that the coil springs 157 apply respective spring forces to the weight 155 toward each other when the weight 155 moves within the housing space of the dynamic vibration reducer body 153 in the longitudinal direction (in the axial direction of the hammer bit 119). Further, preferably, the total spring constant of the two coil springs 157 received in the second spring receiving spaces 156*b* is equal to the spring constant of the coil spring 157 received in the first spring receiving space 156*a*. The coil spring 157 is a feature that corresponds to the "elastic element" according to the invention.

As for the front coil spring 157 received in the first spring receiving space 156*a*, its front end is supported by a front wall part 153*a* of the dynamic vibration reducer body 153, and its rear end is supported by a spring receiver 158 disposed on the bottom of the first spring receiving space 156*a*. As for each of the rear coil springs 157 received in the second spring receiving spaces 156*b*, its front end is supported by a spring receiver 159 disposed on the bottom of the second spring receiving space 156*b*, and its rear end is supported by a rear wall part 153*b* of the dynamic vibration reducer body 153. Thus, the front and rear coil springs 157 exert respective elastic biasing forces on the weight 155 toward each other in the axial direction of the hammer bit 119. Specifically, the weight 155 can move in the axial direction of the hammer bit 119 in the state in which the elastic biasing forces of the front and rear coil springs 157 are exerted on the weight 155 toward each other.

In the above-described dynamic vibration reducer 151 housed within the body 103, the weight 155 and the coil springs 157 serve as vibration reducing elements in the dynamic vibration reducer 151 and cooperate to passively reduce vibration of the body 103 during the operation of the hammer drill 101. Thus, the vibration of the body 103 in the hammer drill 101 can be alleviated during operation. Particularly in this dynamic vibration reducer 151, as described above, the spring receiving spaces 156 are formed inside the weight 155 and one end of each of the coil springs 157 is disposed within the spring receiving space 156. With this construction, the length of the dynamic vibration reducer 151 can be reduced in the axial direction of the hammer bit 119 with the coil springs 157 received and set in the spring receiving spaces 156 of the weight 155, so that the dynamic vibration reducer 151 can be reduced in size in the axial direction of the hammer bit 119.

Further, in this embodiment, as shown in FIG. 4, the first and second spring receiving spaces 156*a*, 156*b* of the spring receiving spaces 156 formed in the weight 155 are arranged to overlap to each other at predetermined region in a longitudinal direction. In other words, the coil spring 157 received in the first spring receiving space 156*a* and the coil springs 157 received in the second spring receiving spaces 156*b* are arranged to overlap to each other in a direction transverse to the extending direction of the coil springs. With such a construction, the length of the weight 155 in its longitudinal direction with the coil springs 157 set in the spring receiving space 156 (156*a*, 156*b*) can be further reduced. Therefore, this construction is effective in further reducing the size of the dynamic vibration reducer 151 in its longitudinal direction and in reducing its weight with a simpler structure. Thus, this construction is particularly effective when installation space for the dynamic vibration reducer 151 within the body 103 is limited in the longitudinal direction of the body 103. Further, the coil springs can be further upsized by the amount of the overlap between the coil spring 157 received in the first spring receiving space 156*a* and the coil springs 157 received in the second spring receiving spaces 156*a*, provided that the length of the dynamic vibration reducer in the longitudinal direction is not changed. In this case, the dynamic vibration reducer 151 can provide a higher vibration reducing effect by the upsized coil springs with stability.

The dynamic vibration reducer 151 having the above-described construction is disposed in a left region (on the left side as viewed in FIG. 3) within the body 103 when the body 103 is viewed from the tool front (from the left as viewed in FIG. 2). Specifically, as shown in FIG. 3, the dynamic vibration reducer 151 is disposed within a left region of an interior space 110 of the gear housing 107 to the left of the motion converting section 113. In other words, in the interior space 110 inside the body 103, a region around the motion converting section 113 is likely to be rendered free. Therefore, by installing the dynamic vibration reducer 151 within this region, rational placement of the dynamic vibration reducer 151 can be realized without increasing the size of the body 103 by effectively utilizing a free space within the body 103.

Further, in this embodiment, a pneumatic vibration mechanism 161 is provided which actively drives or forcibly vibrates the weight 155 of the dynamic vibration reducer 151 by utilizing fluctuations of air pressure. The pneumatic vibration mechanism 161 mainly includes an air chamber 163, a piston member 165 that fluctuates the pressure within the air chamber 163 and an air passage 167 that connects the air chamber 163 to the dynamic vibration reducer 151.

As shown in FIG. 2, the pneumatic vibration mechanism 161 is disposed by utilizing a rear region at the rear of the swinging ring 129 or particularly a rear region at the rear of the swinging rod 128 within the internal space 110 of the gear housing 107. Specifically, an inner housing 108 is disposed in the rear of the gear housing 107 and has a vertical wall 108*b* in a direction transverse to the axis of the hammer bit 119 and a cylindrical portion 108*c* having an open front end and formed on the vertical wall 108*b*. The air chamber 163 is defined by an inner wall of the cylindrical portion 108*c* and a rear surface of the piston member 165. The piston member 165 is fitted into the cylindrical member 108*c* such that it can slide in the axial direction of the hammer bit 119. The air chamber 163 is formed on the extension of the axis of the hammer bit 119. The air chamber 163 is a feature that corresponds to the "second air chamber" according to the invention. The cylindrical portion 108*c* extends further forward over the swinging rod 128, and the cylindrical guide holding portion 108*a* is formed on the extending end of the cylindrical portion 108*c*. The cylindrical guide holding portion 108*a* has a larger diameter than the cylindrical portion 108*c* and serves to rotatably support the above-described hammer guide 139. Further, an opening 108*d* is formed in between the cylindrical portion 108*c* and the guide holding portion 108*a* in order to avoid interference with the swinging rod 128.

The piston member 165 is coupled to the swinging rod 128 of the swinging ring 129 and caused to reciprocate within the air chamber 163 by swinging movement of the swinging ring 129. Thus, the piston member 165 is provided as a pressure fluctuating member to fluctuate the pressure within the air chamber 163. The piston member 165 is a feature that corresponds to the "driving member" according to the invention. In this embodiment, the piston member 165 and the piston 141 are coaxially disposed on the opposite sides of the swinging rod 128 of the swinging ring 129. Further, the piston member 165 is connected to an arm 142 that extends rearward from the rear surface of the piston 141.

The arm 142 for connecting the piston member 165 and the piston 141 is connected to the swinging rod 128 via a spherical connecting structure. The spherical connecting structure includes a connection 166 having a concave spherical surface 166*a* formed on the arm 142 and a ball 124 fitted into the connection 166. Thus, the piston 141 and the piston member 165 are connected to the swinging rod 128 such that they are allowed to pivot in all directions with respect to the swinging rod 128 by sliding movement of the ball 124 in spherical contact with the connection 166. The swinging rod 128 is loosely fitted into a through hole 124*a* passing through the center of the ball 124 and formed through the ball 124, and allowed to slide with respect to the ball 124 along and around the longitudinal direction of the through hole 124*a*. Further, in the above-described embodiment, the arm 142 and the swinging rod 128 are connected with each other via the ball 124, but a cylindrical element may be used in place of the ball 124. In other words, it is necessary for the arm 142 and the swinging rod 128 to be connected with each other such that they can relatively pivot around a horizontal (transverse) axis transverse to the longitudinal direction of the piston 141 in FIG. 2.

In this embodiment, the piston 141 and the piston member 165 are integrally formed of resin together with the arm 142. Further, a circular opening 166*b* through which the ball 124 is fitted into the connection 166 is formed in the connection 166 of the arm 142. Thus, the ball 124 is mounted by fitting into the connection 166 through the circular opening 166*b* by utilizing flexibility of resin. Therefore, the connection 166 is not necessary to have a split structure, so that a rational spherical connecting structure can be realized.

Further, the piston member 165 has a cylindrical shape having an open front end and a closed rear end, and an outer surface of the rear end portion of the piston member 165 is held in sliding contact with the inner wall surface of the air chamber 163. Thus, the sliding performance of the piston 141 with respect to the hammer 143 can be ensured. In the construction in which the swinging movement of the swinging ring 129 is transmitted to the piston 141 as linear motion, the piston 141 that reciprocates within the hammer 143*a* may be acted upon by a force in a direction that twists the piston 141 (a force other than in its moving direction). As a result, sliding performance of the piston 141 with respect to the hammer 143 may be impaired.

In this embodiment, the piston member 165 that linearly moves to fluctuate pressure in the air chamber 163 is guided to slide in contact with the inner circumferential wall surface of the air chamber 163. Thus, the piston member 165 serves as a sliding guide for the piston 141. Specifically, the piston member 165 forms a slider and the inner circumferential wall surface of the air chamber 163 (the inner circumferential surface of the cylindrical portion 108*c*) forms a sliding guide. The piston member 165 and the inner circumferential wall surface of the air chamber 163 form the "sliding guide" according to the invention. Thus, in this embodiment, the sliding movement of the piston 141 is guided at two points to the both sides of the swinging ring 129 in the longitudinal direction by the hammer 143 and the cylindrical portion 108*c* of the inner housing 108 which is a component part of the air chamber 163. Therefore, the piston 141 is prevented from twisting with respect to the hammer 143, so that the piston 141 can obtain smooth and stable sliding performance.

The air chamber 163 communicates with the rear second spring receiving space 156*b* of the dynamic vibration reducer 151 via the air passage 167. As shown in FIG. 5, the air passage 167 includes a recessed groove 168 formed in the inner housing 108 and a groove cover 169 that covers the top of the recessed groove 168. The air passage 167 communicates at one end with the air chamber via a first communication hole 167*a* formed in the inner housing 108 and also communicates at the other end with the second spring receiving space 156*b* of the dynamic vibration reducer 151 via a second communication hole 167*b* formed in the inner housing 108 and the dynamic vibration reducer body 153. The recessed groove 168 is formed along the rear surface of the vertical wall 108*b* of the inner housing 108 and the groove cover 169 is mounted on the rear wall of the inner housing 108 by a screw 169*a* so as to cover the recessed groove 168. Further, the first spring receiving space 156*a* of the dynamic vibration reducer 151 communicates with the internal space 110 of the gear housing 107 via a vent hole 153*c* formed in the dynamic vibration reducer body 153.

The pressure in the air chamber 163 fluctuates in relation to the driving of the motion converting section 113. Specifically, the piston member 165 is caused to reciprocate within the air chamber 163 in the longitudinal direction by the swinging movement of the swinging ring 129 which is a component part of the motion converting section 113. By this reciprocating movement, the volume of the hermetically closed air chamber 163 is caused to fluctuate, so that the pressure in the air chamber 163 fluctuates. Air in the air chamber 163 is compressed (pressure is raised) by rearward movement of the piston member 165, while air in the air chamber 163 is expanded (pressure is reduced) by forward movement of the piston member 165. In this embodiment, pressure fluctuations in the air chamber 163 are introduced into the rear first spring receiving space 156*b* of the dynamic vibration reducer 151, and the weight 155 of the dynamic vibration reducer 151 is actively driven or forcibly vibrated, so that the dynamic vibration reducer 151 can reduce vibration caused in the body 103. With this construction, in addition to the above-described passive vibration reducing function, the dynamic vibration reducer 151 also serves as an active vibration reducing mechanism by forced vibration, so that it can effectively alleviate vibration caused in the body 103 in the longitudinal direction during hammering operation or hammer drill operation.

In this embodiment, the pneumatic vibration mechanism 161 for the dynamic vibration reducer 151 is provided by utilizing a rear region at the rear of the swinging ring 129 which is a component part of the motion converting section 113, or particularly a rear region at the rear of the swinging rod 128, within the internal space 110 of the gear housing 107. In the hammer drill 101 that drives the piston 141 by swinging movement of the swinging ring 129, a region at the rear of the swinging ring 129 and above the motor output shaft 111*a* exists as a free space. According to this embodiment, the pneumatic vibration mechanism 161 can be rationally provided by effectively utilizing the free space within the body 103 without increasing the size of the body 103.

Further, in this embodiment, the piston member 165 and the piston 141 are coaxially disposed. When the piston member 165 and the piston 141 are operated by swinging movement of the swinging ring 129 and compress air in the air chamber 163 or air in the air spring chamber 143*a*, a reaction force caused by this compression is transmitted from the piston member 165 to the piston 141 or from the piston 141 to the piston member 165 via the swinging rod 128. In this respect, according to this embodiment, with the construction in which the piston member 165 and the piston 141 are coaxially disposed, the reaction force is transmitted along the same axis. Therefore, useless stress which, for example, may cause a twist is not easily generated on the swinging rod 128, so that the durability can be effectively improved.

Further, in this embodiment, the piston member 165 and the piston 141 are integrally formed. With such a construction, the number of parts can be reduced, which leads to improvement in ease of assembling operation.

Further, in this embodiment, the air passage 167 that connects the air chamber 163 of the pneumatic vibration mechanism 161 and the second spring receiving space 105*b* of the dynamic vibration reducer 151 is formed in the vertical wall 108*b* of the inner housing 108 within the gear housing 107. Therefore, in contrast, for example, to a construction in which such connection is made by using a pipe and a pipe connecting operation must be performed in a limited region within the gear housing 107, such a pipe connecting operation is not necessary and thus ease of assembling operation can be improved.

Further, in this embodiment, the piston member 165 and the piston 141 are described as being coaxially disposed, but they may be disposed on different axes. Further, the piston 141 and the piston member 165 may be formed by separate members and individually connected to the swinging ring 129.

Further, in this embodiment, the dynamic vibration reducer 151 is described as being disposed in a region to the left of the motion converting section 113 as viewed from the front of the hammer drill 101, but it may be disposed in regions other than the left region, for example, in a right region, both in the right and left regions or in an upper region. Further, the air passage 167 may be formed by piping.

Further, in the above-described embodiment, the hammer drill is explained as a representative example of the impact tool, but the invention can be applied to a hammer that performs a predetermined operation by linearly driving a tool bit.

DESCRIPTION OF NUMERALS

101 hammer drill (impact tool)
103 body (tool body)
105 motor housing
107 gear housing
108 inner housing
108*a* guide holding portion
108*b* vertical wall
108*c* cylindrical portion
108*d* opening
109 handgrip
109*a* trigger
110 internal space
111 driving motor
111*a* motor output shaft
113 motion converting section
114 power transmitting section
115 striking mechanism
117 barrel
119 hammer bit (tool bit)
121 driving gear
123 driven gear
124 ball
124*a* through hole
125 driven shaft
126 bearing
127 rotating element
128 swinging rod
129 swinging ring (swinging member)
131 first transmission gear
133 second transmission gear
135 torque limiter
137 tool holder
139 hammer guide
141 piston
143 hammer
142 arm
145 impact bolt
147 bearing
151 dynamic vibration reducer
153 dynamic vibration reducer body
153*a* front wall part
153*b* rear wall part
153*c* vent hole
155 weight
156 spring receiving space (spring receiving part)
156*a* first spring receiving space
156*b* second spring receiving space
157 coil spring
158 spring receiver
159 spring receiver
161 pneumatic vibration mechanism
163 air chamber
165 piston member (driving member)
166 connection
166*a* concave spherical surface
166*b* circular opening
167 air passage
167*a* first communication hole
167*b* second communication hole
168 recessed groove
169 groove cover
169*a* screw

What we claim is:

1. An impact tool which performs a hammering operation by linearly moving a tool bit at least in an axial direction of the tool bit comprising:

a motor, a swinging member that swings in the axial direction of the tool bit by rotation of the motor, a driving element that reciprocates by swinging movement of the swinging member, a first air chamber in which pressure fluctuates by reciprocating movement of the driving element, wherein the tool bit is driven by pressure fluctuation of the first air chamber, a second air chamber in which pressure fluctuates by swinging movement of the swinging member and a dynamic vibration reducer having a weight and an elastic element that exerts a biasing force on the weight, wherein the weight under the biasing force of the elastic element is forcibly vibrated by pressure fluctuation of the second air chamber.

2. The impact tool as defined in claim 1 further comprising a driving member mounted to the swinging member to fluctuate pressure in the second air chamber, wherein the driving member and the driving element are disposed on the opposite sides of the swinging member.

3. The impact tool as defined in claim 2, wherein the driving member and the driving element are coaxially disposed.

4. The impact tool as defined in claim 2, wherein the driving member and the driving element are integrally formed with each other.

5. The impact tool as defined in claim 1 further comprising a driven shaft extending in a longitudinal direction of the tool bit and a rotating element integrally coupled to the driven shaft, the rotating element having an inclined outer periphery with a predetermined inclination angle to the driven shaft, wherein the swinging member is relatively rotatably coupled to the inclined outer periphery of the rotating element.

6. The impact tool as defined in claim 1 further comprising a housing that houses at least the swinging member, wherein the dynamic vibration reduce is disposed by utilizing an inner space formed within the housing.

7. The impact tool as defined in claim 1, wherein the dynamic vibration reducer is provided with a plurality of elastic elements, each elastic element being disposed to overlap to each other at a predetermined region in the vibrating direction of the weight of the dynamic vibration reducer.

* * * * *